United States Patent [19]

Nakazawa

[11] Patent Number: 4,955,734

[45] Date of Patent: Sep. 11, 1990

[54] INFORMATION PROCESSING APPARATUS

[75] Inventor: Shinichiro Nakazawa, Tokyo, Japan

[73] Assignee: Canon Kabushiki Kaisha, Tokyo, Japan

[21] Appl. No.: 463,821

[22] Filed: Jan. 17, 1990

Related U.S. Application Data

[63] Continuation of Ser. No. 185,276, Apr. 18, 1988, abandoned, which is a continuation of Ser. No. 902,108, Aug. 29, 1986, abandoned, which is a continuation of Ser. No. 640,742, Aug. 14, 1984, abandoned.

[30] Foreign Application Priority Data

Aug. 18, 1983 [JP] Japan ..... 58-149676

[51] Int. Cl.[5] ..... B41J 5/30

[52] U.S. Cl. ..... 400/63; 400/279; 400/697.1; 340/709

[58] Field of Search ..... 400/279, 697.1, 283, 400/63; 340/709, 715

[56] References Cited

U.S. PATENT DOCUMENTS

| | | | |
|---|---|---|---|
| 3,780,846 | 12/1973 | Kolpek et al. | 400/697.1 |
| 4,136,395 | 1/1979 | Kolpek et al. | 400/63 |
| 4,244,031 | 1/1981 | Isushima et al. | 400/63 |
| 4,245,918 | 1/1981 | Bowles | 400/279 |
| 4,264,226 | 4/1981 | Bowles et al. | 400/279 |
| 4,286,889 | 9/1981 | Ebert et al. | 400/697.1 |
| 4,323,315 | 4/1982 | Demonte et al. | 400/63 |
| 4,374,626 | 2/1983 | Hooker | 400/697.1 |
| 4,408,918 | 10/1983 | Smith | 400/697.1 |
| 4,561,793 | 12/1985 | Blanchard, Jr. | 400/697.1 |
| 4,585,362 | 4/1986 | Gray | 400/697.1 |

FOREIGN PATENT DOCUMENTS

| | | | |
|---|---|---|---|
| 16880 | 1/1983 | Japan | 400/697.1 |
| 175686 | 10/1983 | Japan | 400/697.1 |

OTHER PUBLICATIONS

"Word Processing Training Reference Manual", Wang Laboratories, Inc. 1979, pp. 33 and 34.

"Basic Text Editing", Wang Laboratories, Inc. 1982, pp. 7-29 through 7-38.

*Primary Examiner*—Eugene H. Eickholt

*Attorney, Agent, or Firm*—Fitzpatrick, Cella, Harper & Scinto

[57] ABSTRACT

There is disclosed an information processing apparatus such as a word processor or a typewriter enabling rapid and easy erasure of the printed characters. Instead of moving the carriage to the position of the character to be erased, the operator enters the character to be erased, whereby the carriage is automatically moved to the proper position.

10 Claims, 3 Drawing Sheets

INFORMATION PROCESSING APPARATUS

This application is a continuation of application Ser. No. 185,276 filed Apr. 18, 1988, now abandoned, which is a continuation of application Ser. No. 902,108 filed Aug. 29, 1986, now abandoned, which is a continuation of application Ser. No. 640,742 filed Aug. 14, 1984, now abandoned.

BACKGROUND OF THE INVENTION

1. Field of the Invention

The present invention relates to an information processing apparatus, such as a word processor or a typewriter, capable of rapid correction of entered characters.

2. Description of the Prior Art

In the apparatus of the above-mentioned type, such as an electronic typewriter, erasure of the erroneously printed characters requires a movement of the carriage to the position of the character to be erased for example by the manipulation of a back space key, and therefore a considerable time is required for such cumbersome carriage movement.

SUMMARY OF THE INVENTION

In consideration of the foregoing, an object of the present invention is to provide an information processing apparatus capable of rapidly and exactly moving the position for inputting information to the position of a character to be erased or corrected.

Another object of the present invention is to provide an information processing apparatus capable, by entering a character, which is the same as the character to be erased or corrected through a key operation, of detecting the position of the character to be erased or corrected and moving the information input position to the position of the character to be erased or corrected.

Still another object of the present invention is to provide a printing apparatus, such as an electronic typewriter, capable of rapidly and exactly moving a carriage to the print position of a character to be erased and also capable of easily erasing the same characters printed in plural positions.

The foregoing objects can be achieved according to the present invention by a printing apparatus in which, upon entry of a character the same as the character to be erased through a key operation in combination with an erasing key operation, the position of a character to be erased in an erasable range is designated as a tabulator position and the carriage is rapidly moved to that position by the manipulation of a tabulator key.

DETAILED DESCRIPTION OF THE PREFERRED EMBODIMENTS

Now the present invention will be explained in detail with reference to preferred embodiments shown in the attached drawings.

Figure 1:
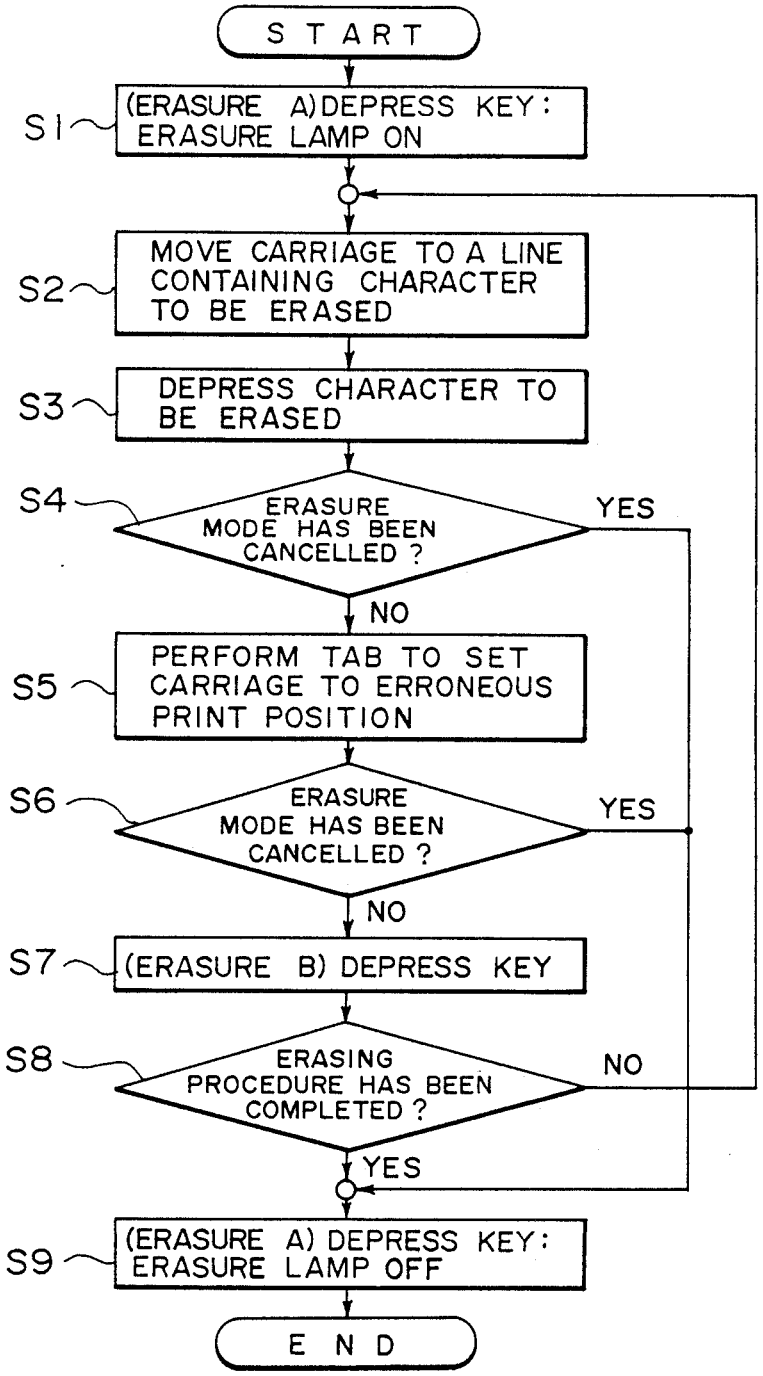
FIG. 1 is a flow chart showing the procedure for erasing a character in the information processing apparatus of the present invention.

At first reference is made to FIG. 1 showing a flow chart of a character erasing procedure which is executed by the information processing apparatus of the present invention in case an erroneously printed character is to be found and erased.

In said flow chart, an ERASURE A key on the keyboard is actuated in, a step S1, whereby an erasure mode is assumed and an ERASURE lamp on the keyboard is turned on.

Then, in a step S2, the carriage is moved to a line containing the character to be erased, by means of a back-line spacing operation with a back-trace key or of a line reversing operation with a reverse key.

Subsequently the character to be erased is entered in a step S3 through a character key actuation, whereby a central processing unit (CPU) searches for the thus entered character to be erased from among the characters stored in a memory, and sets the print position of the character corresponding to the thus entered character as a tabulator position in the memory.

A subsequent step S4 discriminates whether the erasure mode has been cancelled, and if not a back-tabulator key on the keyboard is actuated in a step S5 whereby the carriage is caused the move in one motion to the print position of the character to be erased, according to the above-mentioned tabulator position stored in the memory.

Then a step S6 again discriminates whether the erasure mode has been cancelled, and if not an ERASURE B key of the keyboard is actuated in a step S7, whereby the CPU transmits an erasing command to the printer to erase the character.

A subsequent step S8 discriminates whether the erasing procedure has been completed, and, if the same characters in different positions are to be erased in succession, the program returns to the step S2 to repeat the above-described procedure.

In case the completion of the erasing procedure is discriminated in the step S8 in the course of the above-described repetition, the program proceeds to a step S9 in which the ERASURE A key is again actuated, whereby the erasure mode is cancelled and the ERASURE lamp of the keyboard is turned off. Also in case another character is to be erased after the erasure of a first character, the above-described erasing procedure is executed again.

Figure 2:
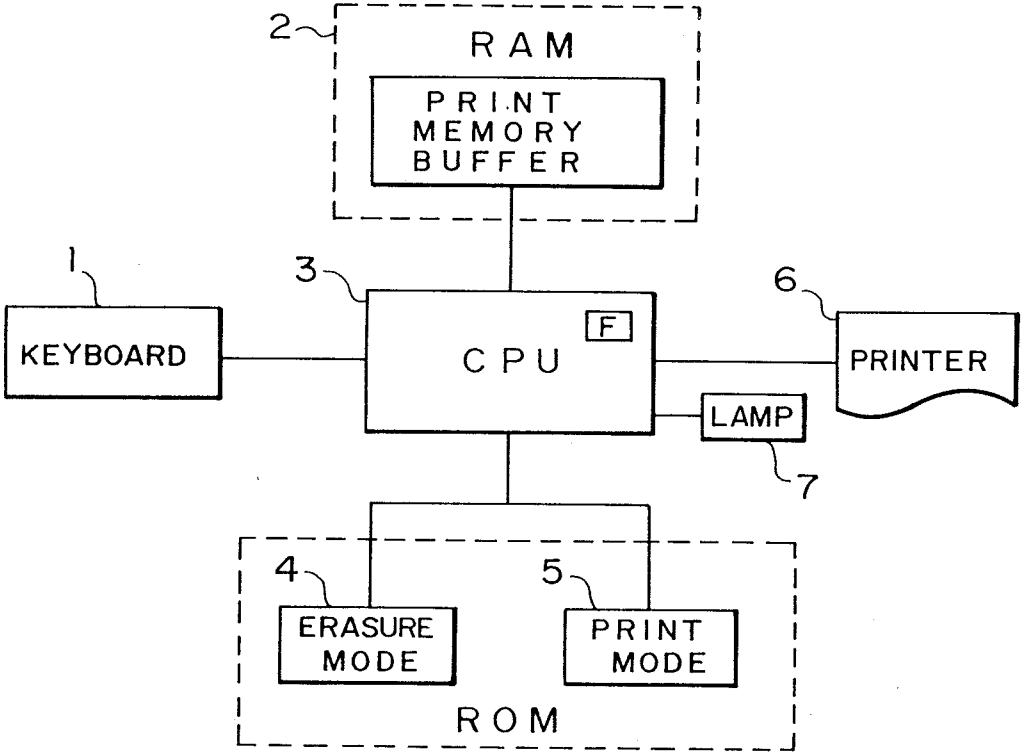
FIG. 2 is a block diagram schematically showing the structure of the apparatus.
Figure 3:
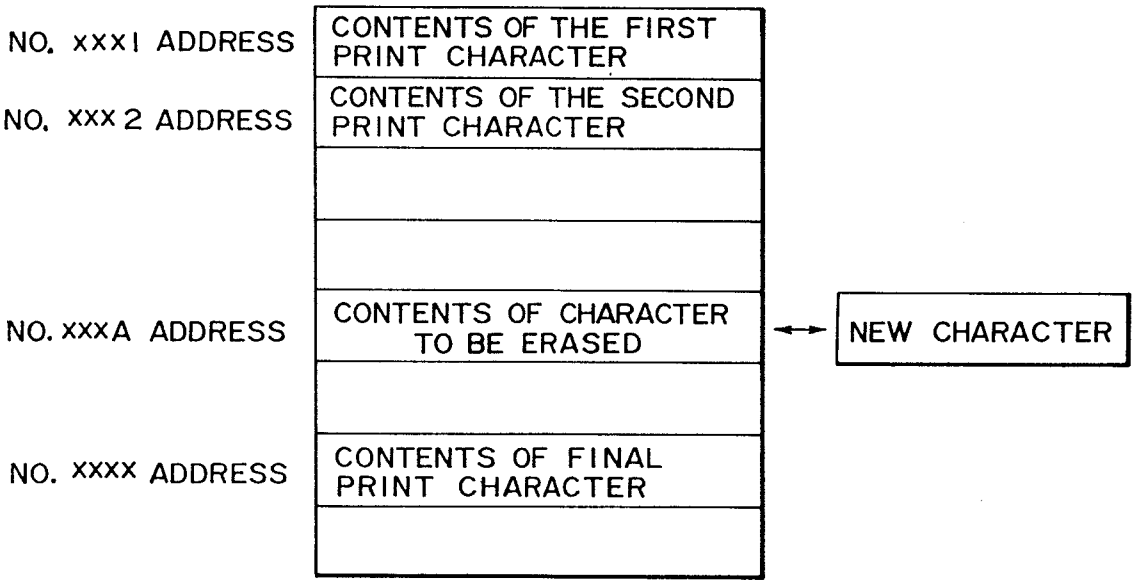
FIG. 3 is a chart showing the content of a print buffer memory in the apparatus.

Now there will be given an explanation of the structure of the apparatus of the present invention, while making reference to FIG. 2 showing the structure thereof schematically and FIG. 3 showing an example of content of a random-access print buffer memory.

Figure 4:
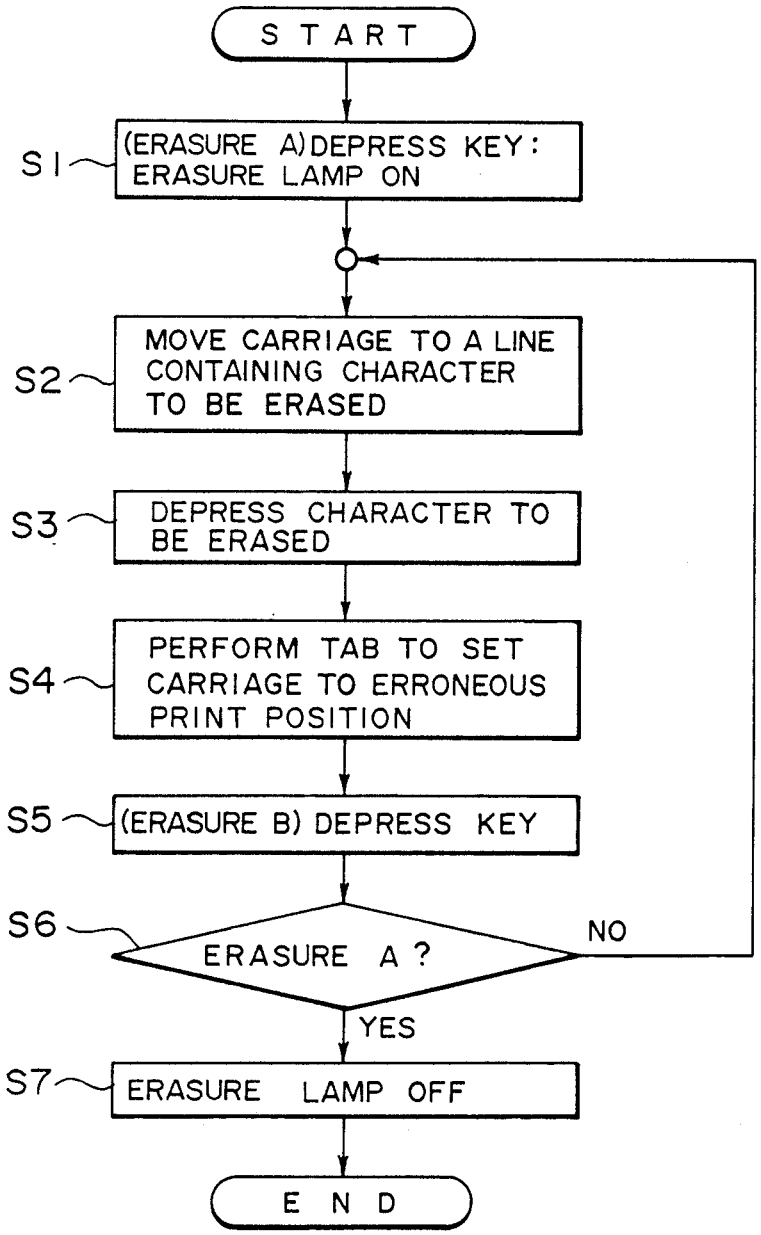
FIG. 4 is a flow chart showing another erasing procedure.

In FIG. 2 there are shown a keyboard 1 containing keys for letters, numerals, symbols, a space, back-line spacing, reversing, ERASURE A, ERASURE B etc.; a central processing unit CPU for logic and arithmetic calculations and control and provided with a flag F for storing a state "1" in response to the actuation of said ERASURE A key; a control read-only memory ROM storing the control procedures and containing a memory ROM 4 for storing the procedure of the erasure mode as shown for example in FIGS. 1, 4 and a memory ROM 5 for storing the procedure of the print mode; and a random access memory RAM 2 for storing the entered characters to be printed by a printer 6, having contents shown for example in FIG. 3.

In the structure schematically shown in FIG. 2, the data entered through the keys of the keyboard 1 are supplied through the central processing unit CPU (3) and temporarily stored in the random-access print buffer memory RAM (2). Then, after processing in the central processing unit CPU (3) under the control of the erasure mode read-only memory ROM 4 and the print mode read-only memory ROM 5 storing various control programs, they are supplied to the printer 6 for conducting necessary printing or erasing operations.

In case an erroneously printed character is found in the course of the above-mentioned print mode, the erasure mode is selected by the actuation of the ERASURE A key as explained before to effect the procedure for correcting the erroneously printed character.

More specifically, in response to the actuation of the ERASURE A key, the processing unit CPU sets the flag F thereby turning on the ERASURE lamp 7 in a step S1. Then, in a step S2, the carriage is returned to a line containing the erroneously printed character by the actuation of the back-line spacing key or the reversing key of the keyboard 1. This is achieved by reversing the platen on which a printing sheet is wound with respect to a printing head mounted on the carriage.

Then, in a step S3, there is actuated a character key corresponding to the erroneously printed character. Upon entry of a character, the CPU searches the positions of that character in the above-mentioned line and sets the tabulator at the positions of that character.

In a subsequent step S4, the back-tabulator key is actuated to move the carriage to the position of the erroneously printed character.

Then the ERASURE B key is actuated in a step S5 to delete the erroneously printed character from the printing sheet by means of a correcting tape.

On the other hand, the erroneous character in the random-access memory 3 is processing in the following manner. In case the search identifies the character to be erased at an address "XXXA" in the random-access memory 3, the central processing unit CPU (3) changes the memory content at the address to a new correct character. In case the character is to be merely erased, the address is left vacant and is used for storing another key entry. In case there is still another erroneously printed character, the back-line spacing or reversing key is actuated again to repeat the above-described procedure. Upon completion of the correcting procedure, the ERASURE A key is actuated again in a step S6 whereby the flag F is reset in a step S7 to turn off the ERASURE lamp and to restore the print mode.

In case of a new key entry in the print mode after all the addresses of the random-access memory 3 are filled, the content of the address "XXXI" is cleared after printing, and the new key entry is stored in the address. Subsequent new key entries are stored in the same manner successively in the following addresses.

In the foregoing embodiments an entered character for erasure is searched in succession, but it is also possible to accept an arbitrary number of entered characters and to provide a special key for searching such characters or to endow such function to the back-tabulator key.

As explained in detail in the foregoing, the present invention enables, in erasing a printed character in a printing apparatus such as an electronic typewriter, movement of the carriage to the position of the character to be erased in one motion instead of the conventional repeated operations of the backspace key. Consequently carriage movement for the character erasure can be made extremely rapid and exact, and, in addition there is obtained a particular advantage of easily erasing the same characters in different positions.

What I claim is:

1. An information processing apparatus comprising:
input means for entering a plurality of character strings including a character string to be corrected;
memory means connected to said input means for storing therein the plurality of character strings entered by said input means;
printing means for printing the character string stored in said memory means;
search instruction means for instructing a search of the character string to be corrected;
search means for searching in said memory means for a character string which is the same as the character string input by said input means and to be corrected, in response to an instruction of said search instruction means;
tab position set means for setting a tab to a position of the character string searched by said search means; and
control means for positioning said printing means at a tab position set by said tab position set means so as to be capable of printing a new character string.

2. An information processing apparatus according to claim 1, wherein said printing means further comprises a carriage and a printing head mounted on said carriage.

3. An information processing apparatus according to claim 1, further comprising storage means for storing therein the position of the character string searched by said search means and to be corrected.

4. An information processing apparatus according to claim 1, further comprising erasure mode setting means for setting an erasure mode for said apparatus, and wherein the character string can be input by said input means in a case where the erasure mode is set by said erasure mode setting means.

5. An information processing apparatus according to claim 4, further comprising display means for displaying that the erasure mode has been set by said erasure mode setting means.

6. An information processing apparatus for printing on a printing sheet, said apparatus comprising:
a carriage having a printing head opposed to the printing sheet for printing character strings on the sheet in lines;
input means including a plurality of keys for inputting a string of characters, and a carriage movement indication key for causing movement of said printing head to a desired position on the printing sheet on which a string of characters to be erased is recorded;
memory means connected to said input means for storing therein the string of characters input by said input means;
mode setting means for setting an erasure mode;
search means for searching in said memory means for a string of characters the same as the string of characters input by said input means and to be erased, in the erasure mode set by said mode setting means;
tab position set means for setting a tab to a position of the character string searched by said search means;

carriage movement means for positioning said carriage at a tab position set by said tab position set means, in response to an operation of said carriage movement indication key; and correction execution means for executing a correction at the tab position at which said carriage is positioned by said carriage movement means.

7. An information processing apparatus according to claim 6, further comprising display means for displaying the state of the erasure mode set by said mode setting means.

8. An information processing apparatus according to claim 6, wherein said carriage movement means sets a tab position in response to the result of the search by said search means so as to determine the movement position of said carriage and moves said carriage into the tab position.

9. An information processing apparatus according to claim 6, wherein said carriage movement indication key includes a back trace key.

10. An information processing apparatus according to claim 6, wherein said carriage movement indication key includes a back tab key.

* * * * *

UNITED STATES PATENT AND TRADEMARK OFFICE

CERTIFICATE OF CORRECTION

PATENT NO. :4,955,734

DATED :September 11, 1990

INVENTOR(S) :Shinichiro Nakazawa

It is certified that error appears in the above-identified patent and that said Letters Patent is hereby corrected as shown below:

On the title page, in item [56] References Cited:

Under "U.S. PATENT DOCUMENTS":

"Isushima al." should read --Izushima et al.--.

COLUMN 1:

Line 20, "erasure of the" should read --the erasure of--

COLUMN 2:

Line 13, "in," should read --in--.

Line 67, "FIGS. 1,4" should read --FIGS. 1 or 4--.

COLUMN 3:

Line 40, "random-access memory 3" should read --random-access memory 2--; and "processing" should read --processed--.

Line 43, "memory 3," should read --memory 2--.

UNITED STATES PATENT AND TRADEMARK OFFICE

CERTIFICATE OF CORRECTION

PATENT NO. : 4,955,734

DATED : September 11, 1990

INVENTOR(S) : Shinichiro Nakazawa

It is certified that error appears in the above-identified patent and that said Letters Patent is hereby corrected as shown below:

COLUMN 3:

Line 55, "random-access memory 3" should read --random-access memory 2--.

COLUMN 4:

Line 7, "characters" should read --character--.

Signed and Sealed this

Thirtieth Day of June, 1992

*Attest:*

DOUGLAS B. COMER

*Attesting Officer*

*Acting Commissioner of Patents and Trademarks*